US010197352B2

(12) United States Patent
Otter

(10) Patent No.: US 10,197,352 B2
(45) Date of Patent: Feb. 5, 2019

(54) RIFLE CLEANING TOOL

(71) Applicant: NHMD LIMITED, Sheffield (GB)

(72) Inventor: Jonathan Otter, South Yorkshire (GB)

(73) Assignee: NHMD LIMITED, Sheffield, South Yorkshire (GB)

( * ) Notice: Subject to any disclaimer, the term of this patent is extended or adjusted under 35 U.S.C. 154(b) by 295 days.

(21) Appl. No.: 14/428,258

(22) PCT Filed: Sep. 19, 2013

(86) PCT No.: PCT/GB2013/052452
§ 371 (c)(1),
(2) Date: Mar. 13, 2015

(87) PCT Pub. No.: WO2014/045037
PCT Pub. Date: Mar. 27, 2014

(65) Prior Publication Data

US 2015/0354914 A1 Dec. 10, 2015

(30) Foreign Application Priority Data

Sep. 19, 2012 (GB) ..... 1216690.6

(51) Int. Cl.
*F41A 29/02* (2006.01)
*F41A 29/00* (2006.01)

(52) U.S. Cl.
CPC ..... *F41A 29/00* (2013.01); *F41A 29/02* (2013.01)

(58) Field of Classification Search
CPC ..... F41A 29/00; F41A 29/02
See application file for complete search history.

(56) References Cited

U.S. PATENT DOCUMENTS

| | | | | |
|---|---|---|---|---|
| 2,379,962 | A * | 7/1945 | Hoerle | F41A 29/02 15/104.165 |
| 4,195,381 | A | 4/1980 | Jurich | |
| 5,379,542 | A * | 1/1995 | Guzman | A47L 13/022 30/123.3 |
| 8,250,800 | B1 | 8/2012 | Johnson | |
| 2009/0199345 | A1* | 8/2009 | Morgan | B25F 1/04 7/118 |
| 2011/0209380 | A1* | 9/2011 | Iosso | F41A 29/02 42/95 |
| 2013/0192118 | A1* | 8/2013 | Shipman | F41C 27/00 42/108 |

(Continued)

FOREIGN PATENT DOCUMENTS

| | | |
|---|---|---|
| GB | 129445 | 7/1919 |
| KR | 20020034131 A | 5/2002 |

(Continued)

OTHER PUBLICATIONS

Doityourself, A Simple Guide to Flat Head Screwdriver Sizes, Apr. 15, 2010, doityourself, datestamp, 2 pages.*

(Continued)

*Primary Examiner* — Michael E Barr
*Assistant Examiner* — Benjamin L Osterhout
(74) *Attorney, Agent, or Firm* — NK Patent Law

(57) ABSTRACT

A breech chamber cleaning tool is provided. The breech chamber cleaning tool has a bar angled so as to form at one end a handle for gripping the tool by hand and at the other end a head for scraping the breech chamber.

6 Claims, 5 Drawing Sheets

(56) References Cited

U.S. PATENT DOCUMENTS

2013/0255722 A1* 10/2013 Davis ..... F41A 29/02
134/8

FOREIGN PATENT DOCUMENTS

WO WO-03104740 A1 * 12/2003 ..... F41A 29/02
WO 2012097307 A1 7/2012

OTHER PUBLICATIONS

Outers, Usage Charts, Mar. 2, 2011, Outers, Datestamp, 3 pages.*
Google, Mar. 11, 2017, Google, definition, Handle.*
Officer.com, Drill-Chuckable Shotgun Cleaning Rod, Oct. 12, 2005, Officer.com, date stamp, tittle, 1 figure, paragraph discussing Brownells drill-chuckable rod.*
Tactical-Life, CJ Weapons' Remington 700 Cleaning Kits, Oct. 27, 2008, Tittle, 1 photograph, 1 paragraph.*
English Oxford Living Dictionaries, Crank, Mar. 11, 2017, English Oxford Living Dictionaries, definition of Crank.*
Sinclair & Rush, Flat Bar Sections—Flexible, Jun. 7, 2011, Sinclair & Rush, date stamp, tittle, 1 photograph, two passages.*
British Plastics Federation, Benefits of Plastics, Oct. 2, 2008, British Plastics Federation, date stamp, tittle, 3 paragraphs.*
American Chemistry Council, Plastics, Sep. 12, 2007, American Chemistry Council, date stamp, tittle, passages regarding durable goods.*
Pro-Shot, Brushes, Bronze Bistle Rifle Length Bore Brushes, Feb. 1, 2002, Pro-Shot, date stamp, paragraph discussing Pro-Shot Benchrest Bore Brush.*
E. Arthur Brown Company, Gun cleaning rods, jags, patches, solvents, and lubricants for cleaning guns and gun barrels., Feb. 1, 2001, E. Arthur Brown Company, date stamp, 1 paragraph and photograph regarding Bench Rest Bronze Bore Brushes.*
Online Etymology Dictionary, Latch, Mar. 11, 2017, Online Etymology Dictionary, definition of latch.*
GB International Search Report search date Jun. 6, 2013 for GB application No. GB1216690.6.

* cited by examiner

RIFLE CLEANING TOOL

CROSS-REFERENCE TO RELATED APPLICATIONS

This application claims priority to PCT Patent Application No. PCT/GB2013/052452 filed on Sep. 19, 2013, which claims priority to GB Application No. 1216690.6 filed on Sep. 19, 2012, the entire contents of both of which are incorporated by reference herein.

FIELD OF THE INVENTION

The present invention relates to a rifle cleaning tool, a breech chamber cleaning tool and a method of cleaning a rifle, in particular but not exclusively a breech chamber of a rifle.

BACKGROUND OF THE INVENTION

A rifle must be regularly cleaned to maintain precision and accuracy of the rifle, and also reduce risk of injury to an operator. A particular area of the rifle that requires cleaning is the breech chamber.

Many rifles include a rotating bolt that is received in and locks in place in the breech chamber, which is also known as the barrel extension or barrel extension chamber. The bolt can be rotated and unlocked from the breech chamber to release a spent casing and/or load a new round. The bolt may be rotated either manually by an operator, or automatically using a mechanical mechanism and gas created when a round is fired.

When a rifle is fired, carbon, oil and dirt collects in the breech chamber. The breech chamber has a complex and intricate geometry which makes it difficult to clean. In particular, the breech often has an undercut which is difficult to access.

Currently the most popular method of cleaning the breech chamber is to use a tool indicated generally at 112 in FIG. 1. The tool 112 has an elongate rod 114, and a head 116 (shown in more detail in FIG. 2) having steel wire bristles 118 extending along the length thereof. The head 116 is connected to the end of the elongate rod 114 by a screw thread connection. To clean the breech chamber a flannelette is positioned over the head 116. The head 116 and flannelette are then positioned in the breech chamber of the rifle by feeding the rod along a bore of the rifle into the breech chamber.

There are several problems with this method of cleaning the breech chamber. Firstly, the steel bristles of the tool wear quickly. Secondly, this cleaning method does not remove all the dirt and debris from the breech chamber. Some tooling kits provide alternative heads for attachment to the elongate rod 114 to improve cleaning, for example a pick. But, providing alternative heads does not solve the problem. Accordingly, many rifle users resort to using their little finger to clean the breech chamber. This is not an ideal solution because a finger can not easily scrape debris from the breech chamber, further it disadvantageously means that a user's finger becomes dirty, and there is a risk of a user injuring their finger.

SUMMARY OF THE INVENTION

The invention seeks to alleviate one or more of the problems associated with the current breech chamber cleaning tool.

Generally, the invention provides a breech chamber cleaning tool that is hand held near a head of the tool, the head being used for scraping the breech chamber. In use, the breech chamber is accessed directly from a side of the breech chamber instead of via a bore of the rifle.

Accordingly, a first aspect of the invention provides a breech chamber cleaning tool. The breech chamber cleaning tool has a bar angled so as to form at one end a handle for gripping the tool by hand. At the other end of the bar there is formed a head for scraping the breech chamber (also known as the bolt extension or bolt extension chamber).

Advantageously, the breech chamber cleaning tool removes the need for an extension rod to be used. Conventionally, it is believed the best method to access the awkwardly positioned breech chamber is to use an extension rod. The inventor of the present invention has gone against this prejudice and provided a tool that can be inserted in the breech chamber from one side of the chamber rather than from directly above the breech chamber removing the need for an extension rod. That is, the breech chamber cleaning tool may be configured for insertion in a breech chamber from one side of said breech chamber.

The advantage of providing a handle at one end of the angled bar is that a user's hand is closer to the head of the tool. This means a user is able to apply greater pressure during cleaning, achieves improved feedback from the tool in terms of sensing debris build up and removal, and can use the tool at a variety of angles not possible with the extension rod tools of the prior art.

Forming the handle and head from angled bar also means that the head has a face and associated edges for scraping a base of the breech chamber and/or one or more faces and associated edges for scraping the sides of the breech chamber. The inventor of the present invention has found that providing these faces and associated edges for scraping the base and sides of the breech chamber provides improved cleaning when compared to the steel wire brushes of the prior art.

In the present application the term 'scraping' includes direct contact between the head and a breech chamber, as well as indirect contact between the head and a breech chamber. For example, 'scraping' includes when a cloth is located between the head and a breech chamber when the tool is in use, e.g. positioning a flannelette over the head so that it is the flannelette not the tool head that directly contacts the breech chamber.

In some embodiments the handle may be formed by a region wider than the remainder of the bar section. The handle may have a circular, square, polygon shaped or any other suitably shaped region. The suitably shaped region may be at one end of the bar. For example, the suitably shaped region may form part of a connection to one or more other components such as an additional tool attachment.

The bar may be cranked between the handle and the head so as to ease positioning of the head within a breech chamber. In exemplary embodiments, a cranked portion of the bar may have a section angled at about 100 to 200°, for example about 150°, to a section adjacent the handle and a section adjacent the head. Such angles have been found to improve access and cleaning performance.

The handle and the head of the breech chamber cleaning tool may be integrally formed. For example, the head and handle may be formed as a single component. The tools of the prior art have a head threadingly engaged with an extension rod which has a handle at an end opposite the head. In such prior art systems it is possible for the connection between the head and the extension rod to loosen.

Integrally forming the head and handle means that any direction of rotation or motion will not loosen or disconnect a connection between the head and the handle, thus providing a more versatile tool. All components of the breech chamber cleaning tool may be integrally formed.

The angled bar may be formed by stamping. The angled bar may be metallic. In such cases, the angled bar may be stamped from a metal plate. Using stamping to form the angled bar means that the tool is cheap and easy to manufacture. Alternatively the angled bar may be formed by cutting a plate (e.g. a metal plate), for example by laser cutting, water jet cutting, or any other suitable methods of cutting plate. The breech chamber cleaning tool may be made from metal, for example mild steel.

The bar may have a width of about 5 to 10 mm.

The bar may be substantially square or rectangular. A substantially square or rectangular cross section eases the manufacture of the tool. A substantially square or rectangular bar section also provides a number of edges associated with faces of the bar for scraping a breech chamber.

The head may be angled at about 70 to 100°, for example about 90°, to the handle. The head may be between about 15 and 40 mm in length, for example about 20 to 30 mm in length, or about 25 mm in length.

The length of the breech chamber cleaning tool may be between about 50 and 100 mm, for example about 60 to 90 mm, about 70 to 80 mm, or about 75 mm. The length of the breech chamber cleaning tool is measured from end to end along a single axis. The handle may be positioned about 40 to 90 mm from head, for example about 60 to 70 mm. The length of the head may be one quarter to one third of the length of the breech chamber cleaning tool.

The breech chamber cleaning tool is suitable for cleaning many rifle types, including but not limited to an M4, AR18 or AK17 made by Armalite, or a SA80 made by Heckler and Koch.

A second aspect of the invention provides a rifle cleaning tool having a breech chamber cleaning tool of the first aspect and one or more tool attachments. Providing two or more tool attachments (including the breech chamber cleaning tool) provides a tool that is versatile and can be used for different aspects of rifle cleaning.

The one or more tool attachments may be pivotally connected to the breech chamber cleaning tool. A pivotal connection permits the rifle cleaning tool to take a compact form for storage or placement in a user's kit bag.

The rifle cleaning tool may have a latch or a hook for fixing one or more of the tool attachments in position relative to the breech chamber cleaning tool. Provision of a latch or a hook means that tool attachments not in use can be fixed in position relative to the tool attachment in use, and as such can be used as a handle or part of the handle for the tool attachment.

The or one of the tool attachments may be an angled bar forming at one end a handle for gripping the tool attachment by hand and at the other end a mount for engagement with a removable brush head for cleaning a roof or a base of a breech chamber. The provision of a removable brush head permits the brush head to be easily replaced if worn. The removable brush head is rotatable relative to the angled bar so as to alter the angle of the bristles relative to the angled bar. Provision of a rotatable brush means that the position of the bristles can be altered for efficient cleaning of different locations on a rifle.

The brush head may have a plurality of polyamide bristles, for example nylon bristles.

The mount may be a projection, which may have the same dimensions as the rest of the bar, for receiving a removable brush. The projection may comprise a ridge to interlock with a corresponding slot on a removable brush. The removable brush may comprise a cap dimensioned to be positioned on the projection. Bristles may be positioned on the cap so as to protrude at substantially about 90° to the projection. The mount may be positioned at an angle of about 120 to 170° to the handle.

The or one of the tool attachments may be a pointed bar section, formed so as to form a handle for gripping the tool by hand at one end and a point for scraping intricate parts of a rifle at the other end. It is commonplace to use a firing pin of a small arms rifle to clean intricate parts of a rifle. This is not desirable, and is a punishable action in many armed forces. The provision of a pointed bar section alleviates the need to use the firing pin for cleaning.

The or one of the tool attachments may be formed by stamping, e.g. a metal plate. Using stamping to form the or one of the tool attachments means that the tool is cheap and easy to manufacture. Alternatively the or one of the tool attachments may be formed by cutting a plate e.g. a metal plate, for example by laser cutting, water jet cutting, or any other suitable methods of cutting a plate.

In an exemplary embodiment where the tool attachments are connected by a pivotal joint, a circular formation to form the pivotal joint may be formed at an end of each of the tool attachments. The circular formation may be formed as part of a stamping or a cutting process. The or one of the tool attachments may be made substantially from metal, for example mild steel. The cross section of the or one of the tool attachments may be substantially square or rectangular. A substantially square or rectangular cross section eases the manufacture of the tool.

A third aspect of the invention provides a method of cleaning a breech chamber of a rifle. The method comprises providing a breech chamber cleaning tool having a bar section angled so as to form a handle at one end and a head at the other end. The handle of the breech chamber cleaning tool is gripped and the head of the breech chamber cleaning tool is inserted into the breech chamber from one side of the breech chamber. The head of the breech chamber cleaning tool is pushed against the breech chamber and the head is moved within the breech chamber so as to scrape debris from the breech chamber.

The advantages associated with the first aspect of the invention are also associated with the third aspect of the invention. In particular, the advantages associated with accessing the breech chamber from one side of the breech chamber rather than from directly above the breech chamber as done conventionally with the extension rod tooling of the prior art.

The breech chamber cleaning tool may be the breech chamber cleaning tool of the first aspect, or may be the breech chamber cleaning tool of the rifle cleaning tool of the second aspect.

The method may comprise locating a flannelette between the head of the breech chamber cleaning tool and the breech chamber, e.g. positioning a flannelette over the head of the breech chamber cleaning tool, or placing a flannelette inside the breech chamber prior to insertion of the breech chamber cleaning tool. Inserting the head of the breech chamber cleaning tool with the flannelette into the breech chamber from one side of the breech chamber, and moving the head and flannelette within the breech chamber.

In an exemplary embodiment, the flannelette may be positioned between the head of the breech chamber cleaning tool and the breech chamber in a primary step of cleaning, i.e. the breech chamber cleaning tool and the flannelette may be used to scrape debris from the breech chamber.

Alternative embodiment, the flannelette in a secondary step of cleaning. For example, the flannelette may be positioned over the head of the breech chamber cleaning tool. The head of the breech chamber cleaning tool with the flannelette may be inserted into the breech chamber from one side of the breech chamber and the head and flannelette may be moved within the breech chamber so as to deposit any debris previously scraped from the chamber (in a primary cleaning step) onto the flannelette.

Using the flannelette removes debris disturbed during scraping from the breech chamber. It is also possible, when a white or lightly coloured flannelette is used to use the flannelette to assess when the breech chamber is sufficiently clean.

The method may comprise using a brush to brush the roof and/or base of the chamber. The brush may be positioned in or on the breech chamber from one side of the breech chamber.

The brush may be removably provided on the end of an angled bar. The method may comprise replacing the brush when the brush becomes worn. The brush is likely to wear at a much faster rate than the rest of the tool. Provision of a removable brush enables the brush to be replaced without the need to replace the entire tool. The method may comprise cleaning a roof or base of the breech chamber and then rotating the brush to clean the base or the roof of the breech chamber.

The method may comprise using a pointed bar section to scrape intricate components of a rifle to remove debris.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
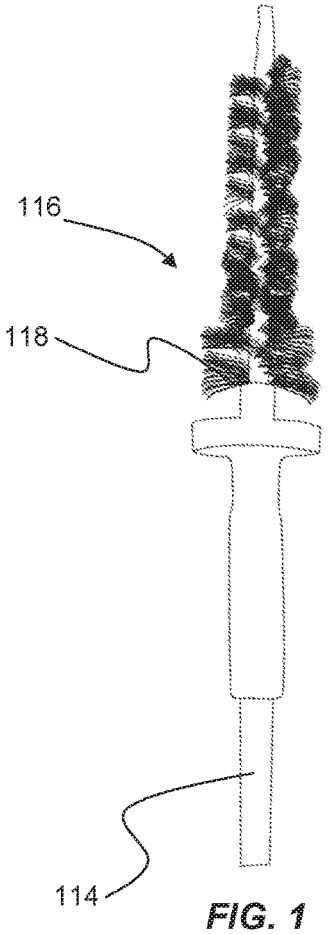
FIG. 1 PRIOR ART
FIG. 1 shows a breech cleaning tool of the prior art.
Figure 2:
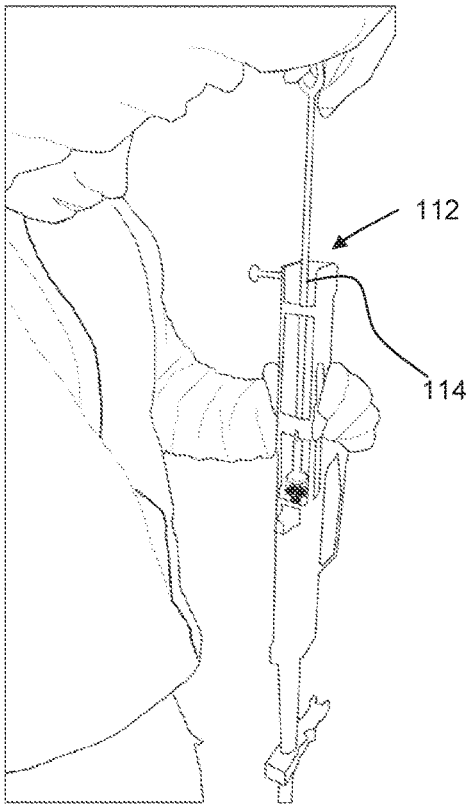
FIG. 2 PRIOR ART
FIG. 2 shows a head of the breech chamber cleaning tool of FIG. 1.
Figure 3:
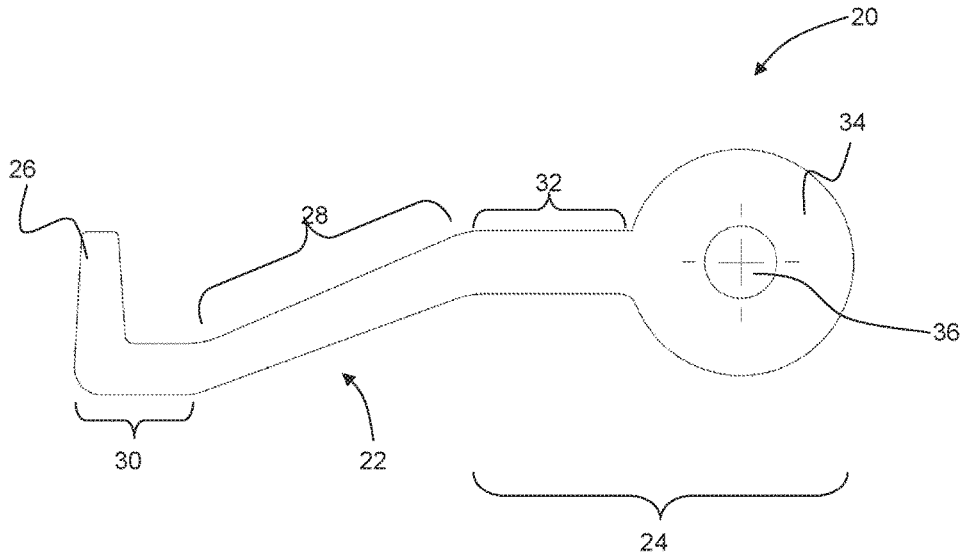
FIG. 3 shows a side view of a breech chamber cleaning tool according to one embodiment.

Referring to FIG. 3, a breech chamber cleaning tool is indicated generally at 20. The breech chamber cleaning tool 20 has a bar section 22. The bar section 22 is angled to form a region 32 that forms part of a handle 24, and to form a head 26.

At an end of the bar section 22 furthest from the head 26 a region 32 is substantially linear. Progressing along the length of the bar section 22 towards the head 26, moving from right to left as shown in FIG. 3, the bar section 22 is angled. The angling creates a region 28 angled, in the same plane, from the region 32 of the bar section so as to form a crank in the bar section 22. The region 28 is angled approximately 150° from region 32. The bar section in the region 28 is tapered from the region 32 to an end nearest the head. The bar section 22 is then angled again so as to form region 30 that is substantially parallel to region 32. The bar section 22 is further angled so as to form the head 26. The angle of the head 26 to the region 30 is approximately 90°.

The width of the head 26 is tapered in the plane of the tool as shown in FIG. 3 so as to be narrowest at a point furthest from the remainder of the bar section 22. In the present embodiment, the thickness at the narrowest point of the head is 4 mm and the thickness of the widest part of the head 26 is 7 mm. In alternative embodiments, the head may not be tapered, or may only be tapered at one side, for example the side of the head furthest the handle of the tool.

Figure 7:
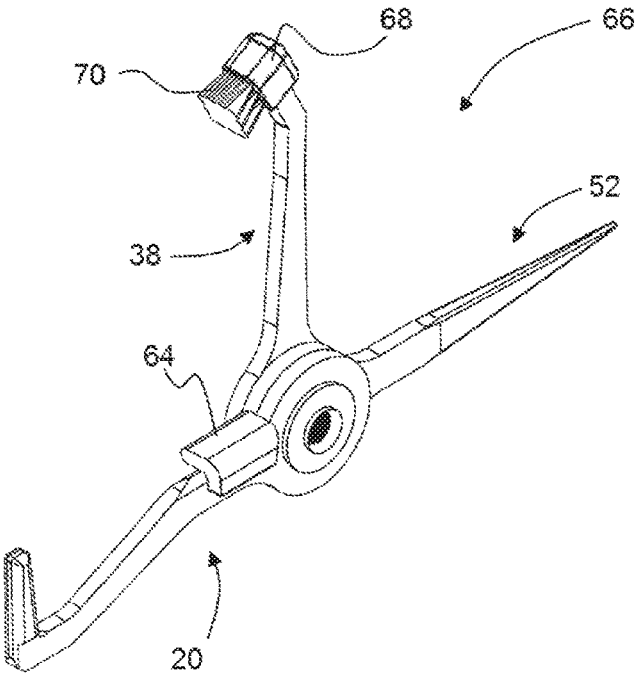
FIG. 7 shows a perspective view of the rifle cleaning tool of FIG. 6.

The side surfaces (i.e. those in alignment with the plane of FIG. 3) of the head are substantially planar. However, as illustrated in FIG. 7, in alternative embodiments said surfaces may be facetted or have a curved profile into and/or out of the plane of FIG. 3.

At an end of the breech chamber cleaning tool furthest from the head 26, i.e. adjacent region 32, there is positioned an circular section 34 having a hole 36 therethrough. The circular section 34 forms part of the region of the tool that can be used as a handle 24. As described later, the circular section 34 and the hole 36 are used to create a pivotal connection with other tool attachments.

The breech chamber cleaning tool has a substantially rectangular cross section along the majority of the length thereof. In this embodiment, the width of the bar section is approximately 7 mm.

Figure 4:
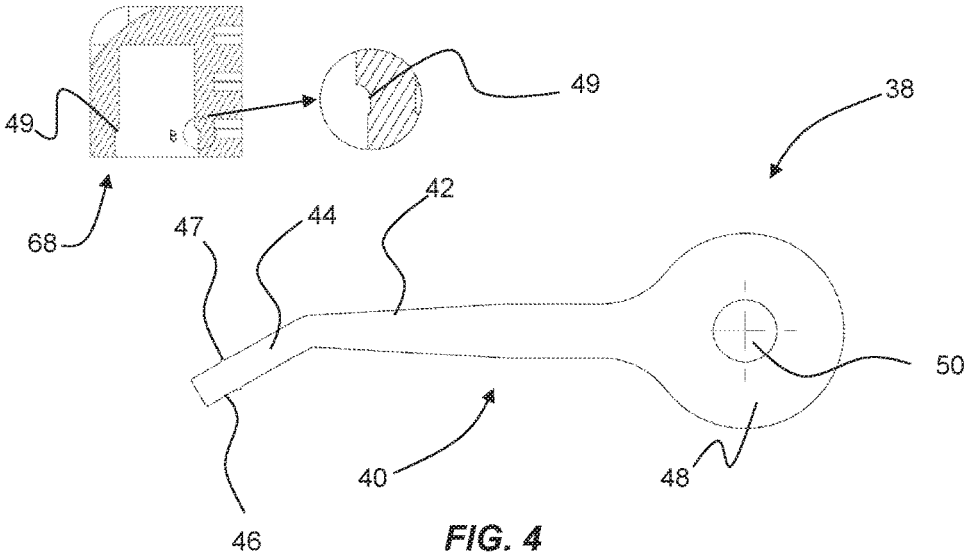
FIG. 4 shows a side view of a brush tool attachment and a cap of a brush for the brush tool attachment.

Referring to FIG. 4 a brush tool attachment is indicated generally at 38. The brush tool attachment 38 has a bar section 40 which is angled to form a first region 42 and a second region 44. The second region 44 being angled from the first region 42 by approximately 150°. A mount 46 is formed on the end of the second region 44. In this embodiment, the mount 46 has a ridge 47 spaced from the end of the brush tool attachment and protruding radially therefrom.

Figure 6:
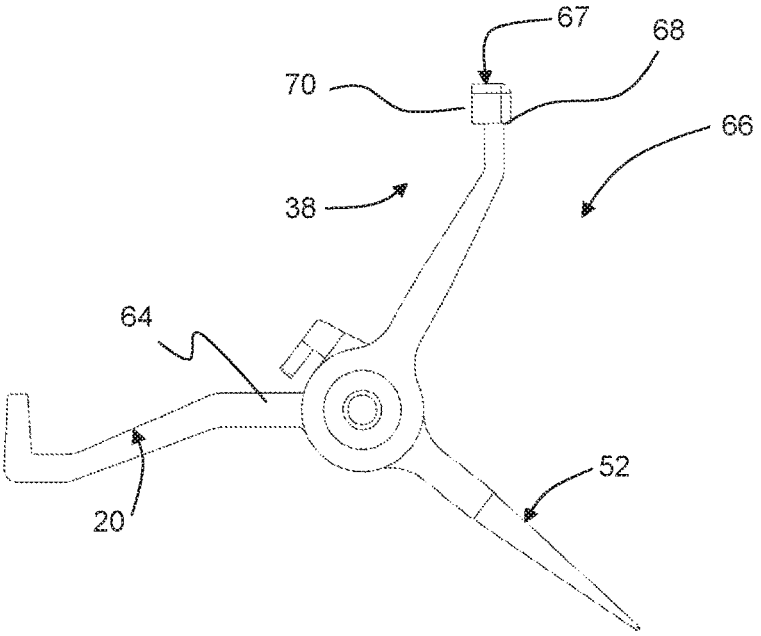
FIG. 6 shows a side view of a rifle cleaning tool having the breech chamber cleaning tool of FIG. 3 and the tool attachments of FIGS. 4 and 5.

Referring to FIGS. 6 and 7, the mount 46 is provided to receive removable brush 69. Removable brush 69 has a cap portion 68 for positioning over the mount 46 of the brush attachment tool 38. When the cap portion 68 is positioned on the mount 46, the ridge 47 interlocks with an internal groove 49 of the cap portion 68, so as to lock the brush 69 in position with respect to the brush tool attachment 38. In alternative embodiments any suitable mount may be used, for example any suitable catch configuration or a screw connection.

The brush 69 has bristles 70 protruding at a right angle to the second region 44 of the bar section 40. In this embodiment the bristles 70 and the cap 68 are made from polyamide, for example nylon 610. However, in alternative embodiments any suitable material may be used, for example any suitable plastics, metallic or elastomeric material. In other embodiments the cap 68 may be made from a different material to the bristles 70. In further alternative embodiments, the cap may have bristles on two or more sides, for example on opposing sides of the cap portion.

In the present embodiment the brush 69 is removable from the brush tool attachment 38. However, in alternative embodiments the brush may be integrally formed with the brush tool attachment. The brush may have two sets of bristles positioned on opposing sides of the brush tool arrangement.

Referring back to FIG. 4, at an end of the brush tool attachment 38 furthest from the mount 46 is positioned a circular section 48 with a central hole 50. In the present embodiment the circular section 48 and central hole 50 are of the same dimensions as the circular section 34 and hole 36 of the breech chamber cleaning tool 20.

Figure 5:
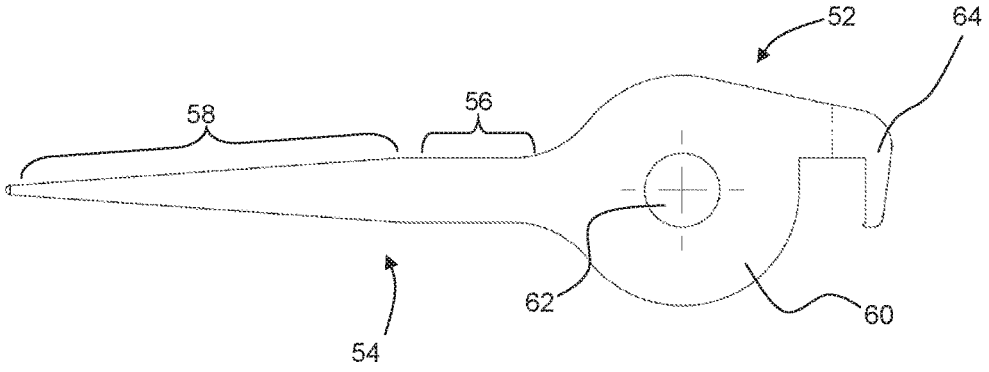
FIG. 5 shows a side view of a pointed tool attachment.

Referring to FIG. 5, a pointed tool attachment is indicated generally at 52. The pointed tool attachment 52 comprises a bar section 54 having a first region 56 and a second region 58. The first region 56 of the bar section is of constant width, and the second region 58 is tapered from the first region 56 to a point at the end of the second region. A circular section 60 with a central hole 62 is formed at an end of the bar section furthest the point of the second region 58. The circular section 60 and central hole 62 have the same dimensions as the circular section 34, 48 and central hole 36, 62 of the breech chamber cleaning tool 20 and the brush tool attachment 38.

Connected to the circular section 60 and protruding therefrom is a projection 64. It can be seen in FIG. 7 that the projection 64 has a thickness greater than the bar section 54 and extends from a lower side of the tool attachment 52, i.e. into the plane of FIG. 5 as well as extending in the plane of FIG. 5. The profile of the projection 64 in the plane shown in FIG. 5 is substantially linear. However, it can be seen from FIG. 7 that the profile of the projection 64 into the plane of FIG. 5 is curved, so as to form a lip at an end furthest from the bar section 54. As will be seen later the projection 64 and lip can be used to hook onto other tool attachments.

Each of the tool attachments, including the breech chamber cleaning tool are made from mild steel. However, in alternative embodiments any suitable metals or plastics material may be used. In the present embodiment, each tool attachment is formed by stamping. Forming the tool attachments using stamping eases the manufacturing process and reduces associated costs. However, in alternative embodiments each or one or more of the tool attachments may be made from cutting the tool attachment from a plate, or by forming bar stock, or by a moulding process, or by any other suitable manufacturing method.

Referring to FIGS. 6 and 7, a rifle cleaning tool is indicated generally at 66. The rifle cleaning tool comprises the breech chamber cleaning tool 20, the brush tool attachment 38 and the pointed tool attachment 52.

The tool attachments are connected together via the circular sections 34, 48, 60 by a clip fitting through the holes 36, 50, 62. The clip being of a type so as to permit relative rotational motion of the tool attachments, i.e. a pivotal connection is formed.

In the configuration shown in FIG. 7, it can be seen that the projection 64 of the pointed tool attachment 52 is hooked onto the breech chamber cleaning tool 20. The projection 64 holds the breech chamber cleaning tool 20 in a fixed position relative to pointed tool attachment 52. This means that in use of the breech chamber cleaning tool 20, the pointed tool attachment 52 can be used as part of the handle of the breech chamber cleaning tool 20.

A method of cleaning a rifle with the rifle cleaning tool of FIGS. 6 and 7 will now be described with reference to FIG. 8. Firstly, labelled 72 in FIG. 8, the rifle is disassembled to a state suitable for cleaning. Details of this step varies with the type of rifle used and is standard for all rifle cleaning processes so will not be described in further detail here.

Figure 8:
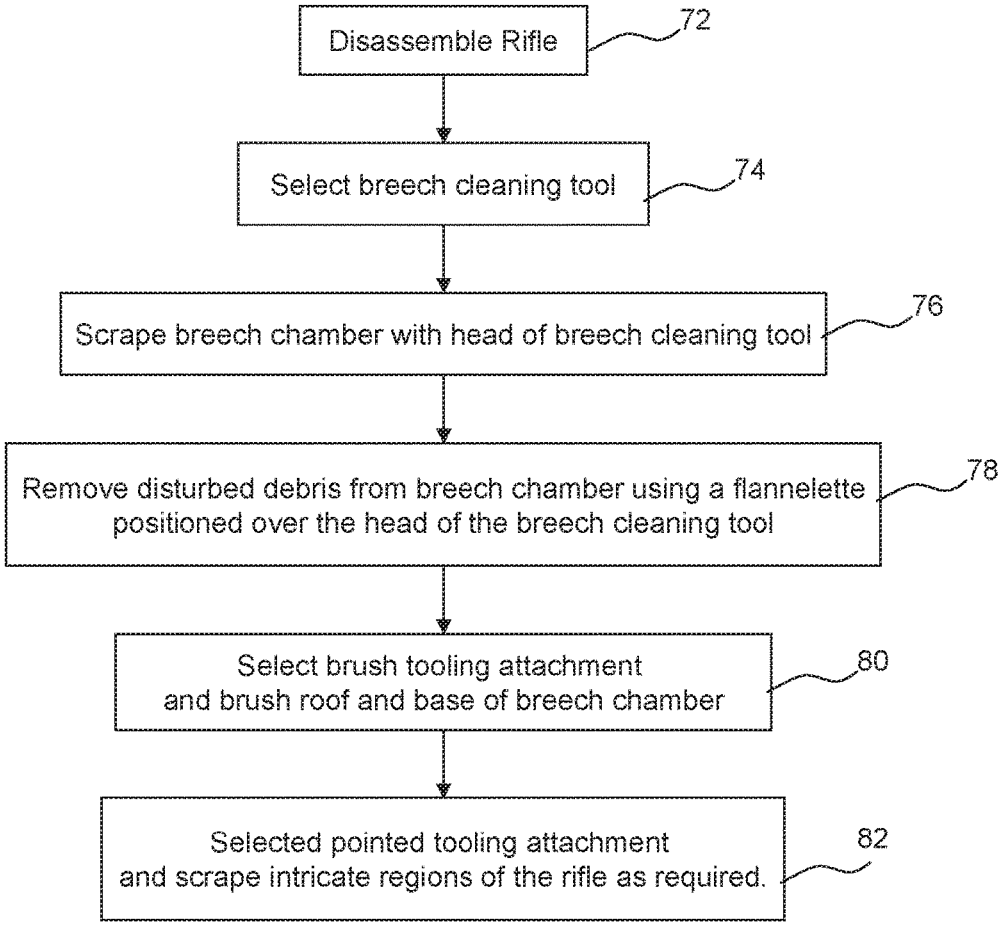
FIG. 8 shows the steps for cleaning a rifle using the rifle cleaning tool of FIG. 6.

At 74 in FIG. 8, the breech chamber cleaning tool 20 is selected. When the rifle cleaning tool 66 is not in use all the tool attachments, i.e. the breech chamber cleaning tool 20, the brush tool attachment 38 and the pointed tool attachment 52 are rotated so as to be aligned and positioned one on top of the other. In this way the rifle cleaning tool takes up the minimum amount of space when not in use. To select the breech chamber cleaning tool 20, the breech chamber cleaning tool 20 is rotated out of alignment with the other two tool attachments. The projection 64 of the pointed tool attachment 52 then hooks onto the bar section 22 of the breech chamber cleaning tool 20 so as to hold the breech chamber cleaning tool 20 in position with respect to the pointed tool attachment 52.

In the next step 76, the breech chamber (also known as the bolt extension or bolt extension chamber) of the rifle is scraped clean with the head 26 of the breech chamber cleaning tool 20. To do this, the rifle cleaning tool 26 is gripped in the region of the handle 24 of the breech chamber cleaning tool 20. A suitable grip is to use a thumb and two fingers. It is suitable to grip the tool in the circular region and a portion of the pointed tool attachment 52 and/or brush tool attachment 38, i.e. the other tool attachments form part of the handle.

Advantageously, provision of a handle 24 of the breech chamber cleaning tool 20 so close to the head 26, when compared to the breech cleaning tool with extension rod of the prior art, allows a user to apply increased pressure and have increased feedback. Increased pressure can improve the cleaning of the rifle.

The head 26 is then positioned in the breech chamber by inserting the head 26 of the breech chamber cleaning tool 20 into an inner region of the rifle from a region to one side of the rifle and the breech chamber, and then moving the breech chamber cleaning tool 20 downwards so as to insert the head into the breech chamber. The head 26 may be rotated and/or twisted so as to be in a desired orientation. Insertion of the head 26 into the chamber in this manner means that the hand is to one side of the breech chamber during cleaning of the breech chamber. It also means that the angle with which the head 26 can be positioned in the breech chamber is not restricted by a bore through which an extension rod is inserted (as with breech chamber cleaners of the prior art). The breech chamber cleaning tool 20 does not need to be inserted through a bore of the rifle which means that the head 26 can have increased dimensions compared to the breech chamber cleaning tools of the prior art.

Once the head 26 is inserted in the breech chamber, a user applies a force to push the breech chamber cleaning tool 20 against the base and/or walls of the breech chamber. At the same time as applying a pushing force the head 26 is slid and/or rotated so as to scrape debris from the breech chamber. During use, the hand of the user is offset from the sides of the breech chamber.

The scraping action continues for a time as desired.

The head 26 is then removed from the breech chamber and cleaned if required.

In the next step 78, a flannelette is positioned over the head 26. As previously described, the head 26 of the breech chamber cleaning tool 20 is then inserted in the breech chamber from one side of the breech chamber. The flannelette and head 26 are rotated and moved in the breech chamber as required to remove any debris disturbed during the scraping process.

Steps 76 and 78 can be repeated as desired. For example, a white or light coloured flannelette may be used, and steps 76 and 78 may be repeated until the flannelette used to cover the head 26 is substantially unmarked when removed from the breech chamber.

In alternative embodiments, a flannelette may be positioned over the head of the tool in step 76, removing the need for step 78. In such an embodiment, the breech chamber may be cleaned by scraping with the flannelette positioned over the head in a similar way as described for step 78 of the previously described method.

When compared to the cleaning methods of the prior art, the present method was found to provide improved cleaning of the breech chamber.

In the described embodiment, no chemical solvents were used. However, in alternative embodiments solvents may be used as required. The type of solvents suitable for such applications are well known in the art.

In the next step 80 the brush tool attachment 38 is used to brush the roof and base of the breech chamber. To do this, the breech chamber cleaning tool 20 is unhooked from the projection 64 of the pointed tool attachment 52 and rotated to be aligned with the pointed tool attachment 52. The brush tool attachment 38 is then rotated away from the other tool attachments. Optionally the projection 64 of the pointed tool attachment 52 can be hooked onto the brush tool attachment 38 so as to fix its position with respect to the pointed tool attachment 52.

The cap 68 of the brush 69 is then positioned on the mount 46 of the brush tool attachment 38, if it is not already in position. To clean the roof of the breech chamber the brush 69 is positioned so that the bristles 70 are in a direction towards a region formed by the angling of the brush tool attachment 38, i.e. the position shown in FIGS. 7 and 8. The brush tool attachment is then inserted to the region of the breech chamber in a manner similar to that previously described. The brush 69 is then used to brush the roof of the breech chamber.

Once the roof of the breech chamber is sufficiently brushed, the brush 69 is removed from the region of the breech chamber. The brush 69 is then removed from the mount 46, rotated through 180° so as to be facing away from the region formed by the angling of the brush tool attachment, and positioned back on the mount 46. In a similar manner to that described for brushing the roof of the breech chamber, the base of the breech chamber is brushed.

As desired, the brush may be used to clean any other regions of the rifle.

In the next step 82, the pointed tool attachment 52 is used to clean intricate parts of the rifle. The intricate parts cleaned are the parts that are often undesirably cleaned using the firing pin of the rifle. To select the pointed tool attachment 52, the tool attachments are rotated in a manner similar to that described previously. The projection 64 of the pointed tool attachment 52 then hooks on to one or both of the other tool attachments.

The rifle can then be reassembled in a form ready to use.

Although the invention has been described above with reference to one or more preferred embodiments, it will be appreciated that various changes or modifications may be made without departing from the scope of the invention as defined in the appended claims. For example, the tool attachments may not be pivotally connected. In such embodiments, each tool attachment may be provided as a separate component. Alternatively, the breech chamber cleaning tool and/or one or more of the tool attachments may be attached to a multi-tool, or additional tool attachments may be added to the rifle cleaning tool. The multi-tool or additional tool attachments may be other rifle cleaning tools or may be other useful tool attachments such as a knife.

The invention claimed is:

1. A rifle cleaning tool comprising: a breech chamber cleaning tool having a bar with a cranked portion angled at a fixed angle so as to form at one end a handle, and at the other end a head for scraping a breech chamber, wherein the bar is cranked between the handle and the head so as to ease positioning of the head within a breech chamber, and one or more tool attachments, the one or more tool attachments including a pin and a brush, wherein the breech chamber cleaning tool, the pin, and the brush are pivotally connected relative to one another about a common pivot point.

2. The rifle cleaning tool according to claim 1, having a latch positioned about the pivot point for fixing one or more of the tool attachments in position relative to the breech chamber cleaning tool.

3. The rifle cleaning tool according to claim 1, wherein the or one of the tool attachments is an angled bar forming at one end a handle and at the other end a mount for engagement within an interior void of a removable brush head for cleaning a roof and/or a base of a breech chamber.

4. The rifle cleaning tool according to claim 3, wherein the mount is positioned at an angle of 120 to 170° to the handle.

5. A tool for cleaning a breech end of a rifle, the tool comprising:

a pin extending from a hinge;

a handle extending from the hinge and being pivotable relative to the pin, wherein the handle has a head for scraping a breech chamber, wherein the handle further comprises a cranked portion with a fixed angle, the cranked portion for easing positioning of the head within a breech chamber such that the head is offset from a longitudinal axis extending through the cranked portion, wherein the head, handle and cranked portion are integrally formed as a single component such that the fixed angle is maintained and the angle is not capable of being adjusted; and wherein the handle is substantially square or rectangular in cross-section along an entire length between a first end and a second end, wherein the handle is rigid to maintain a shape thereof while in use; and a brush tool attachment extending from the hinge and being pivotable relative to the pin and the handle, the brush tool attachment having an end that defines a square or rectangular cross section for being slideably received within a brush head having an interior void that matches the square or rectangular cross section to engage the brush head to the brush tool attachment end, wherein, in operation, a user pivots a selected one of the pin, handle, and brush tool away from the remaining ones of the pin, handle, and brush tool, before inserting the selected one into the breech chamber of a rifle.

6. The tool according to claim 5, further comprising a latch for fixing one or more of the pin, handle, and brush tool in position relative to the remaining tools.

* * * * *